United States Patent [19]

Schmidt et al.

[11] 4,144,553

[45] Mar. 13, 1979

[54] APPARATUS FOR ELECTRODYNAMIC SPRAYING

[75] Inventors: Klaus Schmidt, Hirschberg; Adolf Graber; Hans U. Helbeck, both of Weinheim, Bergstr., all of Fed. Rep. of Germany

[73] Assignee: Firma Carl Freudenberg, Weinhelm, Fed. Rep. of Germany

[21] Appl. No.: 792,620

[22] Filed: May 2, 1977

[30] Foreign Application Priority Data

May 8, 1976 [DE] Fed. Rep. of Germany ..... 2620399

[51] Int. Cl.[2] ..... B05B 5/02

[52] U.S. Cl. ..... 361/227

[58] Field of Search ..... 361/226, 277, 228

[56] References Cited

U.S. PATENT DOCUMENTS 2,718,477 9/1955 Miller ..... 361/226 X

FOREIGN PATENT DOCUMENTS 2230483 1/1974 Fed. Rep. of Germany ..... 361/226

*Primary Examiner*—Harry E. Moose, Jr.

*Attorney, Agent, or Firm*—Sprung, Felfe, Horn, Lynch & Kramer

[57] ABSTRACT

An apparatus for use with a device for producing a suitable electric field to effect the electrodynamic spraying of solutions, dispersions, or mixtures of solids. The apparatus includes at least one spray station for spraying into a given spray zone. Each spray station includes two spaced apart tanks for holding the medium to be sprayed and which are disposed on both sides of the spray zone. An endless band is supported by pulleys disposed at each tank for circulating the band and constantly running a run thereof through the tanks. Squeegees are disposed at each tank to remove excess medium from the band and inlet and outlet connections in each tank effect a desired level of the medium therein.

7 Claims, 14 Drawing Figures

FIG. 1.
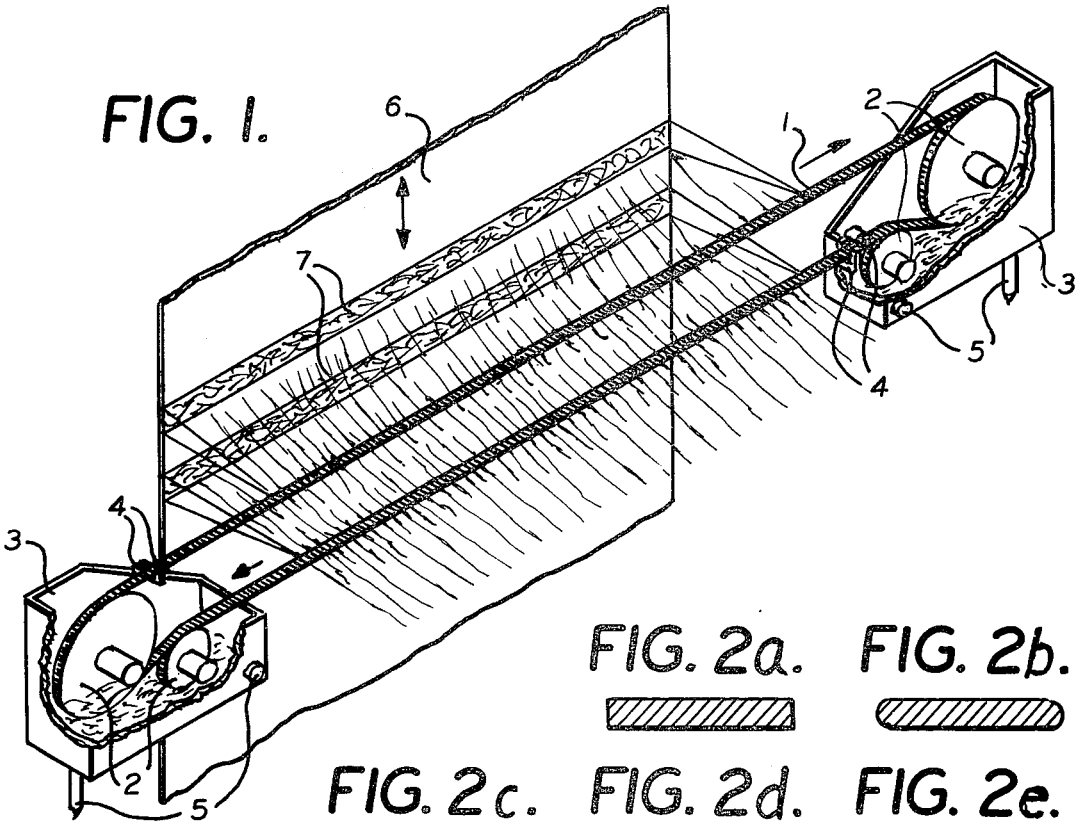
FIG. 2a.
FIG. 2b.
FIG. 2c.
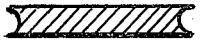
FIG. 2d.
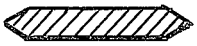
FIG. 2e.
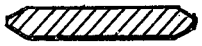
FIG. 3.
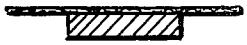
FIG. 4a.
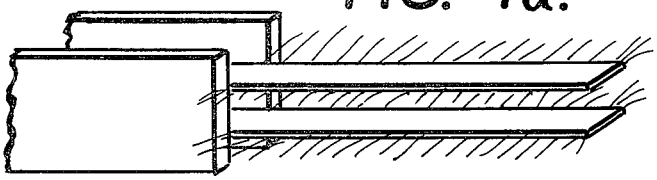
FIG. 4b.
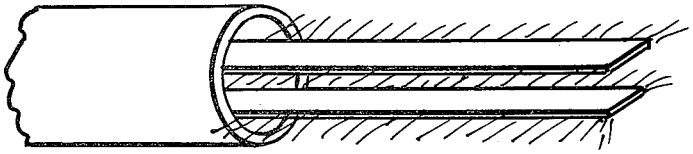
FIG. 5.
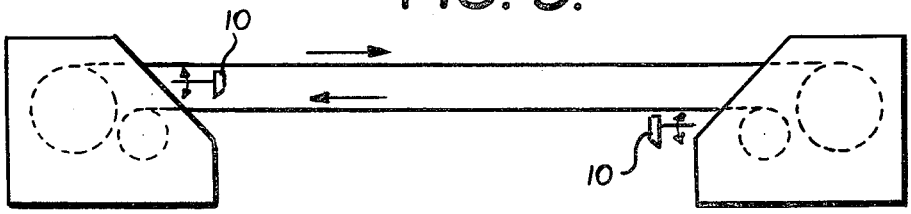

APPARATUS FOR ELECTRODYNAMIC SPRAYING

BACKGROUND

The invention concerns a device for the electrodynamic spraying of solutions, dispersions and mixtures of solids.

It is known that liquids, such as lacquers and dispersions, for example, or solids, such as powder mixtures, can be sprayed electrodynamically onto a suitable support. The material to be sprayed, such as liquid droplets, or small solids, such as dust or staple fibers, are charged in a strong electrical field and transported by the forces of the electrical field. Known applications are paint and lacquer spraying, coating with solids, such as the manufacture of abrasive paper for example, or of electrofilter materials, and the flocking of textile fibers.

The charging of the particles is effected, for example, by means of ionization grids. The transport of the particles to the counterelectrodes is accomplished in a suitable electrical field of various geometry.

Apparatus and methods are known in which the particles are produced mechanically and only deposited electrically. These are termed mechanical-electrical methods. The disadvantage of such application methods is that the loss of material is considerable. The liquid fogs produced, for example, by spray guns, must be blown at a certain velocity into the area of high ion density to receive the electrical charge, and, on account of the inertia of the particles, the result is that not all of them are sufficiently charged and not all of them are then transported in the electrical field to the counterelectrodes.

If the particles to be sprayed are produced electrically rather than mechanically, this method is referred to as electrostatic or electrodynamic spraying. The charging of the media to be transported in the electrical field is accomplished by contact at the spray electrode. By means of suitable apparatus, a sufficiently great electrical charge is produced, which results in the repulsion of like electrical surface charges, which produces the atomization of liquid films, and also produces the dispersion and spraying apart of bundles of fibers and conglomerates of solids. All of these processes for the production of individual particles at an electrode are referred to as spraying. The particles thus produced are then transported in the electrical field along the lines of force to the counterelectrode, and there they are generally deposited in their entirety.

In contrast to mechanical-electrical spraying, therefore, electrostatic spraying involves hardly any losses of material.

On account of the known advantages of electrodynamic spraying processes, numerous apparatus using a variety of spray electrodes have become known. For example, a rotating bell has been proposed (Ransburg, in "Deutsche Farbenzeitschrift," 1957, p. 132), or a rotating disk whose axis of rotation can have any desired inclination to the counterelectrode (Lurgi, "Deutsche Farbenzeitschrift," 1957, p. 133), a ring electrode (Bayer AG, German Pat. No. 20 32 072), and, in simplest form, a spray electrode having a rectilinear edge (AEG, "Deutsche Farbenzeitschrift," 1957, p. 133). On account of the varying geometry of the spray edge, a specific spray pattern is associated with each electrode shape, which consists in a varying quantity-wise distribution of the spray composition on the counter-electrode. For a defined spraying, a number of requirements must generally be fulfilled. Thus, it is necessary for the electrical field to have as simple a symmetry as possible, and this field symmetry should not vary anywhere in the spray zone. The feeding of the material to the spray edges must be uniform and easy to control. The superimposition of mechanical and electrical forces is undesirable. The spraying process must be independent of the solvent that is used, and the drying of solutions on edges and corners of the spray apparatus must not occur.

The above-stated requirements are not fulfilled by the known electrodes to the necessary extent. Rotating electrodes are especially in need of improvement with regard to field symmetry, to the uniform and controllable feeding of the spray edges, and to the undesired superimposition of mechanical and electrical forces, whereas electrodes having stationary edges have a tendency towards the drying out of solutions especially at the ends of the edges, resulting in each case in severe disturbances of the spraying process.

THE INVENTION

The invention, therefore, has the object of developing an apparatus for electrodynamic spraying which will contain a moving spray electrode and will fulfill all of the above-stated requirements so as to assure a trouble-free spray action even in long use.

This object is achieved by an apparatus for the electrodynamic spraying of solutions, dispersions and mixtures of solids, which is characterized by at least one spray station consisting of an endlessly circulating band which is carried around pulleys through containers of the medium being sprayed which are provided at both ends of the spray zone and equipped with squeegees and, if desired, supply and drain connections, and by known apparatus for the production of a suitable electrical field.

In the simplest case, therefore, the apparatus of the invention consists of a single spray station of the above-defined kind. In most cases, however, it has proven to be desirable to set up a plurality of such spray stations in series, which are then disposed beside one another or offset in line one behind the other.

In comparison with known rotating electrodes, such spray stations with endlessly rotating band make possible a hitherto unachieved uniformity of the spray process. In the case of rotating electrodes, such as the ring electrode of German Pat. No. 20 32 072, for example, the surface film of spray solution that forms is not always uniform. The shape and thickness depend on the rotatory speed of the ring, on the viscosity of the solution, and also on the position of the ring segment, for when the upper bow passes through, the spray solution collects by gravity preferentially on the inside of the ring. This also applies to the ascending and descending segments. Consequently, even if the spray solution is well metered out, for example by a round squeegee after leaving the solution tank, the spray zones of the ring are not uniformly fed. The lines of force terminating at the surface of the ring and their density are generally not uniformly distributed over the bow being fed with the solution. Added to this is the shielding effect of the solution tank. The irregular feeding of solution to the ring surface and the electrical field distribution, which are both a result of the ring geometry, then bring about an uneven spraying over the ring surface. If a moving web of goods is being sprayed, there will be a more or less uneven distribution over the width of the goods. For this reason even the otherwise very advantageous ring electrodes cannot be used in a generalized manner.

On the other hand, the apparatus of the invention permits a very regular and uniform spray over the entire width of the goods in accordance with the selected geometrical configuration of the spray zone. This configuration is brought about by masking the spray edges of the circulating band at the desired points with suitable shielding.

In the simplest case, the spray edges can be ordinary, unprofiled, straight edges. It is usually desired, however, that the edge of the band have a radius of curvature, or that it be round or even sharp edged or sawtoothed. For the sake of simplicity the edge will always be referred to herein as the "spray edge," and the term "spray edge" or "band edge" shall refer only to the boundary line of the spraying electrode, not to its geometrical shape, which will be adapted to its application in the above-described manner.

BRIEF DESCRIPTION OF THE DRAWINGS

FIG. 1 shows an illustrative embodiment of a spray station in accordance with the invention;

FIGS. 2*a–e* are cross-sectional views of different band edges;

FIG. 3 is a cross-sectional view of a supported band;

FIGS. 4*a–b* are perspective views of electrode placement;

FIG. 5 is a schematic diagram showing an oscillating mechanism;

DETAILED DESCRIPTION OF THE INVENTION

Figure 6:
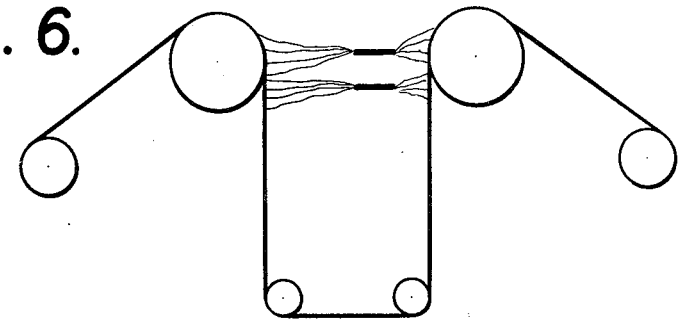
FIG. 6 is a schematic diagram of two bands one upon another.

In FIG. 1, the endlessly circulating band 1 is carried at both ends of the spray zone through containers 3 which are provided with squeegees 4 for wiping off the medium to be sprayed, and also with inlet and outlet 5. The endlessly circulating band 1 is located in an electrical field produced by means of suitable apparatus, under whose influence a suitable medium is sprayed perpendicularly on both sides from the spray edges of the band 1 and deposits itself in zones 7 on the support 6.

The pulleys 2 are disposed at the turn-arounds of the endless band 1 such that the upper and lower portions of the band will have the desired space between them. They are immersed simultaneously in the container of the medium being sprayed, so that the band 1 becomes charged with the spray solution or spray mixture. When the band emerges from the container 3 the excess is wiped off at both ends by means of squeegees 4. By means of the inlet and outlet 5, the level of the spray solution or dispersion is so maintained that the band at least dips into the spray solution at the turn-around points.

In this manner a band coating is obtained which is largely independent of the speed of circulation of the band. The spraying then takes place from the appropriately shaped spray edge, various types of which are shown in FIGS. 2*a–2e* and which in a preferred embodiment is of rounded shape as shown in FIG. 2*b*. The feeding of the spray solution to the spray edge is accomplished by replacement or make-up flow from the back of the band. By plunging into the solution or mixture of the medium being sprayed, the circulating band cleans itself each time and again coats itself with the medium at the turn-around points. In the case of great spray widths, it can be desirable to provide additional support for the band as shown in FIG. 3. By appropriately varying the electrode spacing in the production of the necessary electrical field, as shown in FIGS. 4*a* and 4*b*, different amounts can be sprayed from the spray edge according to the direction of movement. In the case of counter-electrodes running parallel, the electrical field is constant along each of the moving spray edges. By means of suitable apparatus, such as vibrators or rockers shown in FIG. 5, or the like, the band can be made to oscillate transversely.

The returning band sprays basically on the same principle as the going band, and spraying takes place at both spray edges.

The band unit in a spray station thus always has four possible spray edges available. If a single spray station is used to spray onto a continuously moving web of goods perpendicularly to the surface of the band on the spray edge side, a rectangular spray pattern is produced, which is characterized by the application of an equal amount over the width and over the direction of production. The application is controlled, in a constant electrical field, by the position of the squeegee and the band coating that results therefrom, by the band speed and the amount of spray presented in the field at constant band coating, or by the rate at which the webs of goods or the individual objects are moving.

It may be desirable in many cases to adapt the spray pattern to the particular application by masking the lines of force of the band to the counter-electrode. This can be important in the case of narrower webs of goods or individual objects, and also in the marginal zones. The masking of the spray bands acts on spray zones which are moving and running continuously out of the screened area into the field zone or in the opposite direction. Thus, unlike the situation at the end of stationary spray edges, there is no area of the band which is wholly or partially masked continuously over the time period that does not continuously clean itself.

There is no danger that spray solution residues may accumulate at the edges or corners of the spray station, whether or not the latter is in operation. All parts run wet or through the medium to be sprayed, automatically cleaning themselves. This is important especially in the case of highly volatile solvents, after whose evaporation residues from the solution accumulate at stationary edges.

Fundamentally, the polarity of the electrical field can be as desired. The spray media can be known lacquer or varnish systems, dissolved plastics for the preparation of films or fibers for the punctiform or patterned surface coating of surfaces or the improvement of surfaces, or dispersions or mixtures of solids.

Figure 7:
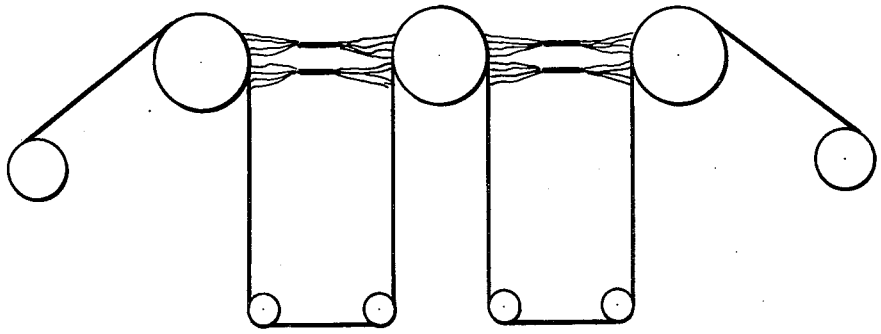
FIG. 7 is a schematic diagram of the two bands FIG. 6 followed side-by-side by another two bands.
Figure 8:
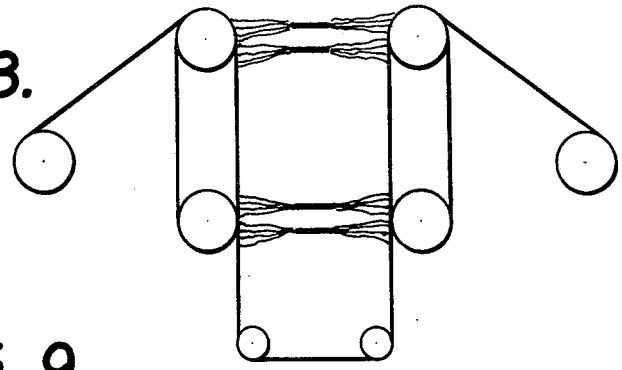
FIG. 8 is a schematic diagram of the two bands of FIG. 6 followed one upon another by another two bands.
Figure 9:
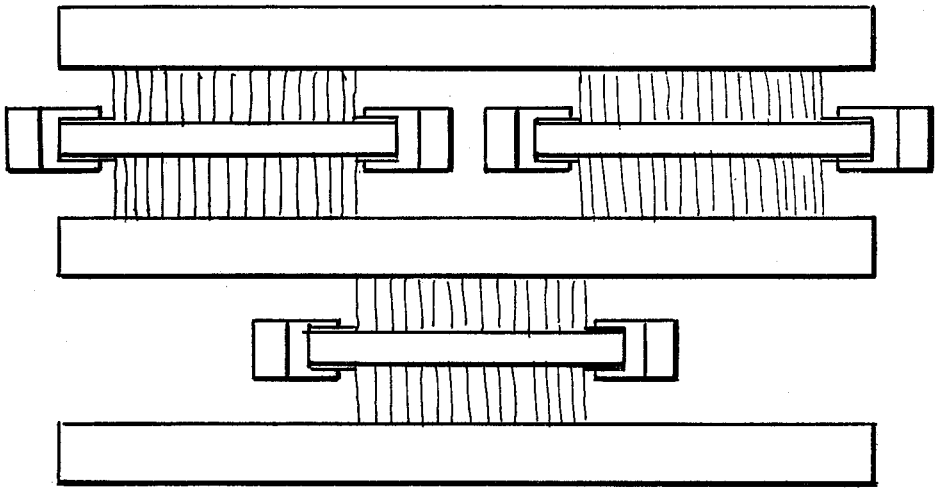
FIG. 9 is a top view of two bands in series with a staggered parallel third band.

Additionally, a plurality of spraying stations can be set up in series and beside one another as shown in FIGS. 6, 7 and 8 to obtain different spray patterns. The spraying stations can alse be set up in series and staggered one behind the other in line as shown in FIG. 9.

It will be appreciated that the instant specification is set forth by way of illustration and not limitation, and that various modifications and changes may be made without departing from the spirit and scope of the present invention.

What is claimed is:

1. An apparatus for use with a device for producing a suitable electric field to effect the electrodynamic spraying of solutions, dispersions or mixtures of solids, comprising at least one spray station for spraying into a given spray zone and including two spaced apart tanks for holding the medium to be sprayed and which are disposed on both sides of the spray zone, an endless band and pulleys disposed at each tank for circulating the band and constantly completely immersing a run thereof in each of the tanks, squeegees disposed at each tank to continuously remove the excess medium from the band before and after the spray zone to continuously define the amount of medium adhering to the band during the spraying and inlet and outlet connections in each tank to effect a desired level of the medium therein.

2. The apparatus according to claim 1, comprising a plurality of spray stations set up in series and disposed beside one another and wherein spraying is effected from both ends of each band.

3. The apparatus according to claim 1, further comprising means for transversely oscillating the circulating band to obtain uniform oscillations thereof.

4. The apparatus according to claim 1, wherein the spray edges of the circulating band are at least one of curved, profiled and locally masked.

5. The apparatus according to claim 1, wherein the device for producing the electrical field has electrodes which are disposed at such a varying distance from the spray station to effect a spraying that differs in quantity on the two sides of the circulating band.

6. The apparatus according to claim 1, further comprising supports in addition to the pulleys for the band for great spray widths.

7. The apparatus according to claim 1, comprising a plurality of spray stations set up in series and disposed staggered one behind the other in line, and wherein spraying is effected from both ends of each band.

* * * * *